US010704344B2

(12) United States Patent
Eksteen

(10) Patent No.: US 10,704,344 B2
(45) Date of Patent: Jul. 7, 2020

(54) TOOLING RACK FOR DRILL PIPES

(71) Applicant: IHC Marine and Mineral Projects (Proprietary) Limited, Cape Town (ZA)

(72) Inventor: Hendrik Nicolaas Basson Eksteen, Vredehoek (ZA)

(73) Assignee: IHC Marine and Mineral Projects (Proprietary) Limited, Cape Town (ZA)

( * ) Notice: Subject to any disclaimer, the term of this patent is extended or adjusted under 35 U.S.C. 154(b) by 108 days.

(21) Appl. No.: 15/754,596

(22) PCT Filed: Aug. 31, 2015

(86) PCT No.: PCT/ZA2015/050006
§ 371 (c)(1),
(2) Date: Feb. 23, 2018

(87) PCT Pub. No.: WO2017/041117
PCT Pub. Date: Mar. 9, 2017

(65) Prior Publication Data

US 2018/0258716 A1 Sep. 13, 2018

(51) Int. Cl.
*E21B 19/14* (2006.01)
*E21B 19/20* (2006.01)

(52) U.S. Cl.
CPC ..... *E21B 19/146* (2013.01); *E21B 19/20* (2013.01)

(58) Field of Classification Search
CPC ..... E21B 19/146; E21B 19/20
See application file for complete search history.

(56) References Cited

U.S. PATENT DOCUMENTS 1,684,008 A * 9/1928 Bouslog ..... E21B 19/14 211/70.4
4,449,592 A * 5/1984 Mayer ..... E21B 19/20 173/164
4,455,116 A * 6/1984 Lindstedt ..... E21B 19/146 175/52

(Continued)

FOREIGN PATENT DOCUMENTS

CA 2073617 A1 1/1993
EP 0942146 A2 9/1999

(Continued)

*Primary Examiner* — Nicole Coy
(74) *Attorney, Agent, or Firm* — N.V. Nederlandsch Octrooibureau; Catherine A. Shultz; Katelyn J. Bernier

(57) ABSTRACT

A tooling rack (1) for storing slender objects, such as pipes (4), comprises at least one rack element (6) which is provided with at least one slot (7). Each slot is bordered by resilient opposite holding elements (10, 11) between which an object is to be accommodated. The resilient opposite holding elements (10, 11) exert a holding force on the object (4), respectively give way to release the object against said holding force. Furthermore, with the aim of securing the objects against shocks and the like, locking means (12-16) are provided. These locking means in a locking state engage the resilient opposite holding elements (10, 11) and prevent said resilient opposite holding elements from giving way and from releasing the holding force exerted on the object (4), and an idle state in which said resilient opposite holding elements are allowed to give way and release the object.

19 Claims, 4 Drawing Sheets

(56) References Cited

U.S. PATENT DOCUMENTS

| | | | | | |
|---|---|---|---|---|---|
| 5,174,389 | A * | 12/1992 | Hansen | E21B 19/146 175/52 |
| 5,954,209 | A * | 9/1999 | Wurm | E21B 19/146 175/52 |
| 6,164,391 | A * | 12/2000 | Wurm | E21B 19/146 175/52 |
| 7,631,704 | B2 | 12/2009 | Hagemeyer et al. | |
| 9,428,971 | B2 * | 8/2016 | Pyorny | E21B 7/025 |
| 2014/0224540 | A1 * | 8/2014 | Pyorny | E21B 7/025 175/52 |

FOREIGN PATENT DOCUMENTS

| | | | | |
|---|---|---|---|---|
| GB | 1441538 | A * | 7/1976 | E21B 19/14 |
| GB | 2175629 | A | 12/1986 | |

* cited by examiner

*- Prior Art-*

TOOLING RACK FOR DRILL PIPES

The invention is related to a tooling rack for storing slender objects, such as pipes, comprising at least one rack element which is provided with at least one slot, each slot being bordered by resilient opposite holding elements between which an object is to be accommodated, said resilient opposite holding elements being carried out for exerting a holding force exerted on the object, respectively for giving way to release the object against said holding force.

Such a tooling rack is known from EP-A-942146 and may accommodate a plurality of drill pipes which are used in a drill string. By means of a manipulator, the drill pipes are successively removed from the tooling rack and are assembled in the course of drilling a hole. Conversely, when removing the drill string from the hole, for instance for the purpose of changing a worn out drill bit, the drill pipes are removed from the drill string and stored in the tooling rack.

In such a process, each drill pipe is inserted into the respective slot and is subsequently held therein through the elastic holding forces exerted by the spring clamps bordering the slot. Thus, an efficient and rapid storage action is possible; conversely, the drill pipe is easily removed from the slot and out of the spring clamps. In the course of these actions, the friction force between the spring clamp and the drill pipe can easily be overcome by the manipulator.

Despite the efficient handling of the drill pipes in this way, the prior art tooling nevertheless has a drawback. In certain circumstances, the spring clamps are prone to lose the drill pipe accommodated therein. This is caused by the fact that the friction forces exerted by the spring clamp should be limited so as to make the placement into, and respectively removal from, the slot possible. The limitation of the maximum holding force however creates situations where the drill pipe may accidentally be lost due to shocks from sharp knocks experienced by the tooling rack during operation.

The object of the invention is to provide a tooling rack of the type described before which solves this problem, and which is able to reliably hold the drill pipes in the case of relatively high accelerations exerted on the tooling rack and/or on the drill pipes accommodated therein. This object is achieved by providing locking means which in a locking state engage the resilient opposite holding elements and prevent said resilient opposite holding elements from giving way and from releasing the holding force exerted on the object, and which in an idle state allow said resilient opposite holding elements to give way and release the object.

In the tooling rack according to the invention, the drill pipes may be accommodated into, respectively removed from, the respective slots against the friction force exerted thereon by the spring clamps as usual. However, in the case where shock-type loadings are expected to occur, the spring clamps can be immobilized so as not to give way by activating the locking means. Thereby, the drill pipes are firmly held in the respective slot, without the risk of slipping out of the tooling rack under the influence of shocks and the like. Nevertheless, the drill pipes can still be handled as desired once the risk of shocks has subsided and the locking means are deactivated.

Preferably, the tooling rack comprises at least two spaced rack elements which are positioned with respect to each other such that a slot of one rack element is aligned to a respective slot of another rack element forming pairs or sets of slots, each pair or sets of slots being able to accommodate a single object. Usually, the rack elements are positioned above each other for storing the drill pipes in a standing, vertical position, although it is also possible to store the pipes lying, in a horizontal position by positioning the rack elements next to each other.

The holding elements preferably each comprise an elastic spring. The springs of opposite holding elements may carry a friction element, such as a plastic element. Each pipe can then be gripped between two opposite friction elements, and preferably two pairs of such opposite friction elements.

The locking means preferably comprise cams which are displaceable between an active position in engagement with a respective spring, and an idle position free from the respective spring. In the case where each rack element comprises multiple slots each bordered by elastic springs, a double cam may be provided between the spring of one slot and the neighboring spring of an adjacent slot; said double cam in its active position simultaneously engages both said neighbouring springs. Preferably, each cam is rotatable between the active and the idle position. Alternatively, the cam may be displaceable according to a rectilinear movement towards and from the respective spring element.

The spring elements themselves may be carried out in several ways as well, for instance according to a U-shape as disclosed in the above-mentioned prior art. Preferably, each spring is a blade spring one surface of which carries the friction element and the opposite surface of which is engaged by the cam. The blade spring surfaces are directed in accordance with the longitudinal direction of the respective slot and the longitudinal direction of the object to be accommodated in said slot.

In the case of U-shaped springs, the ends of the spring elements are free. However, preference is given to an embodiment wherein a blade spring has opposite ends which are both suspended with respect to the respective rack element. In such a way, a firm holding force can be exerted on the objects.

Furthermore, several pairs of holding elements may be arrangement behind each other in the longitudinal direction of a slot, each pair being carried out for accommodating a respective object. Thus, quite a large number of drill pipes can be held within the tooling rack. In this case, the locking elements of respective holding elements lie behind each other in the longitudinal direction of the slot and are preferably simultaneously operable, e.g. by means of a common rotatable shaft.

The tooling rack is preferably carried out as a carousel, in which case the slots of each rack element are oriented radially with respect to a central axis which is generally parallel to the objects to be accommodated in said slots. Nevertheless, the tooling rack may also be carried out in a comb-shape, having parallel slots.

The invention is also related to a drilling installation, comprising a frame, a drilling apparatus accommodated on the frame for rotary driving a drill string composed of successive interconnected drill pipes, as well as a tooling rack as described before for storing a supply of drill pipes to be used for composing the drill string.

The invention will now be described further with reference to an embodiment shown in the drawings.

Figure 2:
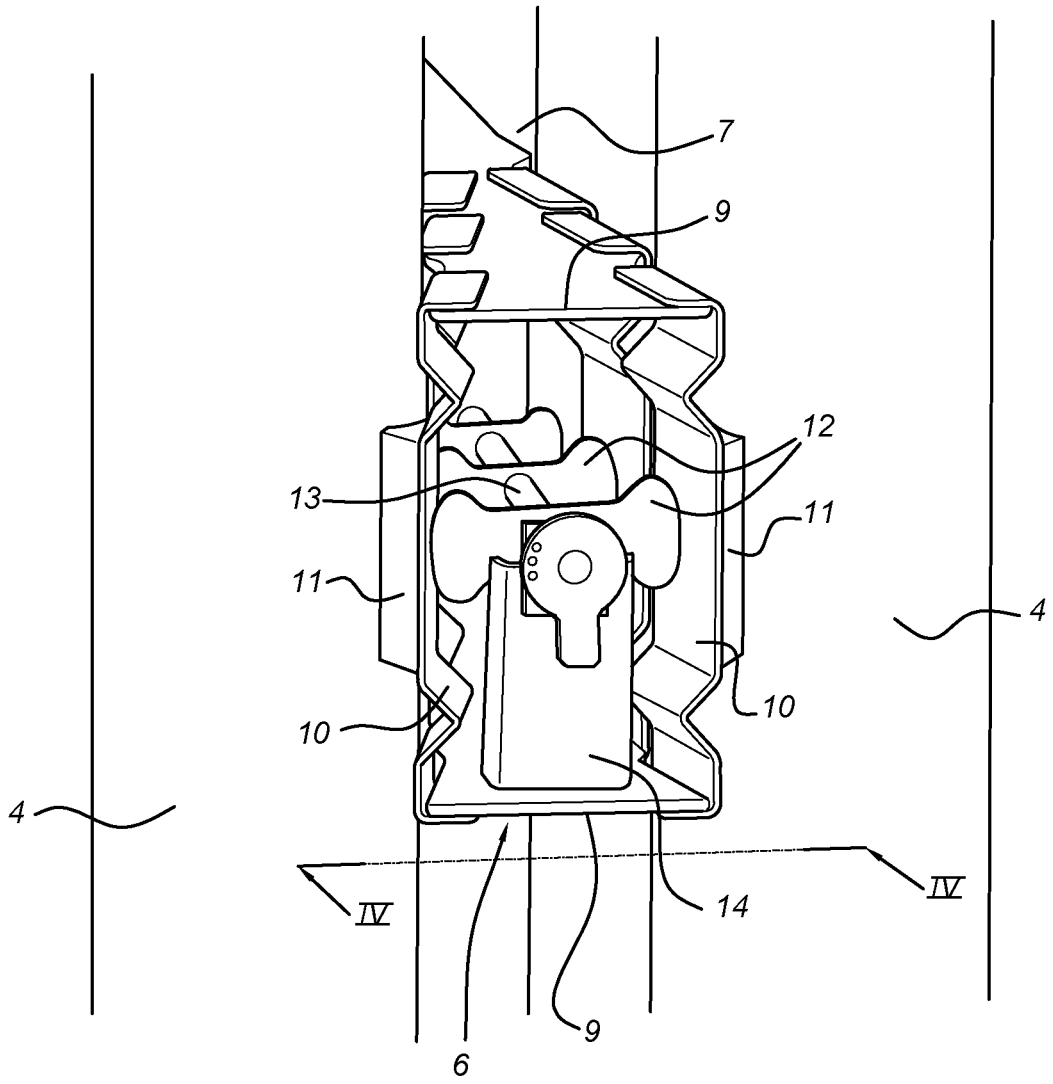
FIG. 2 shows a view according to II-II of FIG. 1.
Figure 4A:
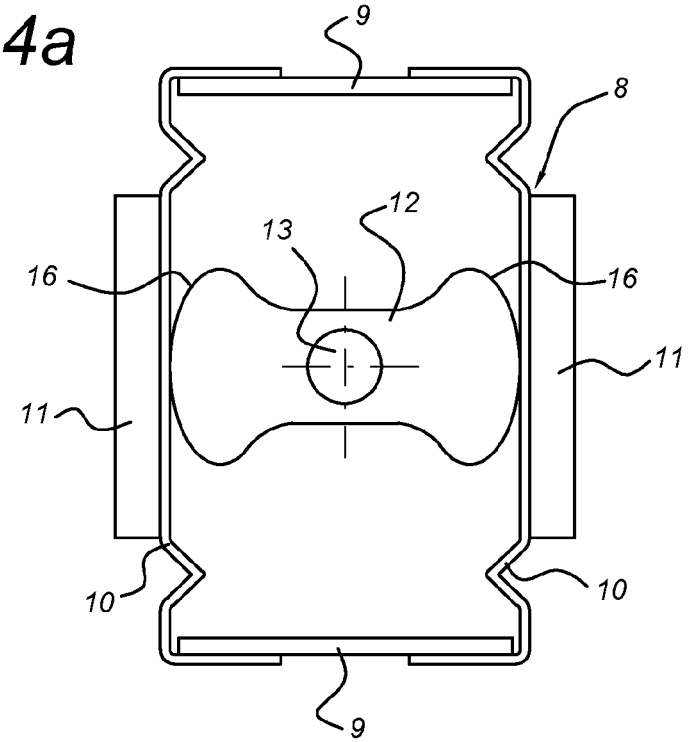
Figure 4B:
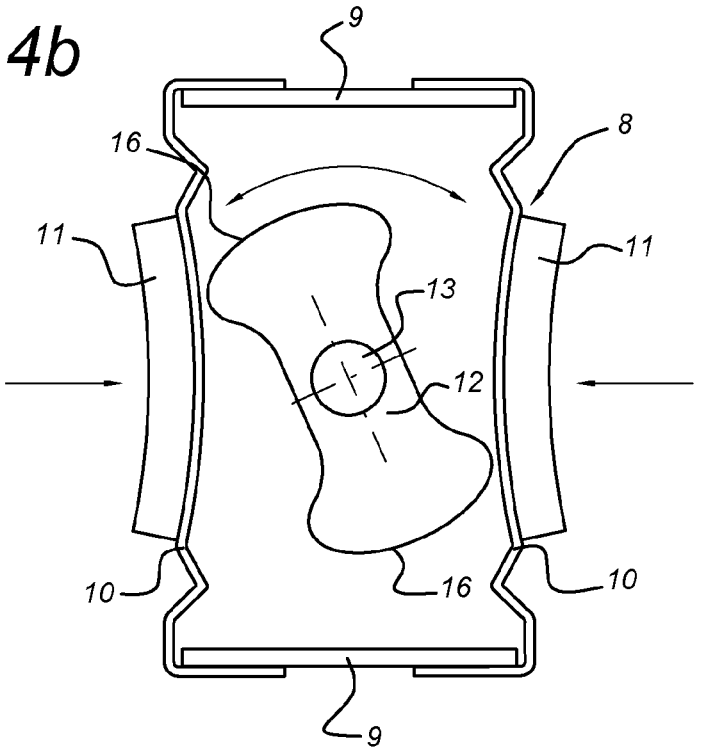

FIGS. 4*a* and 4*b* show views according to IV-IV of FIG. 2.

Figure 1:
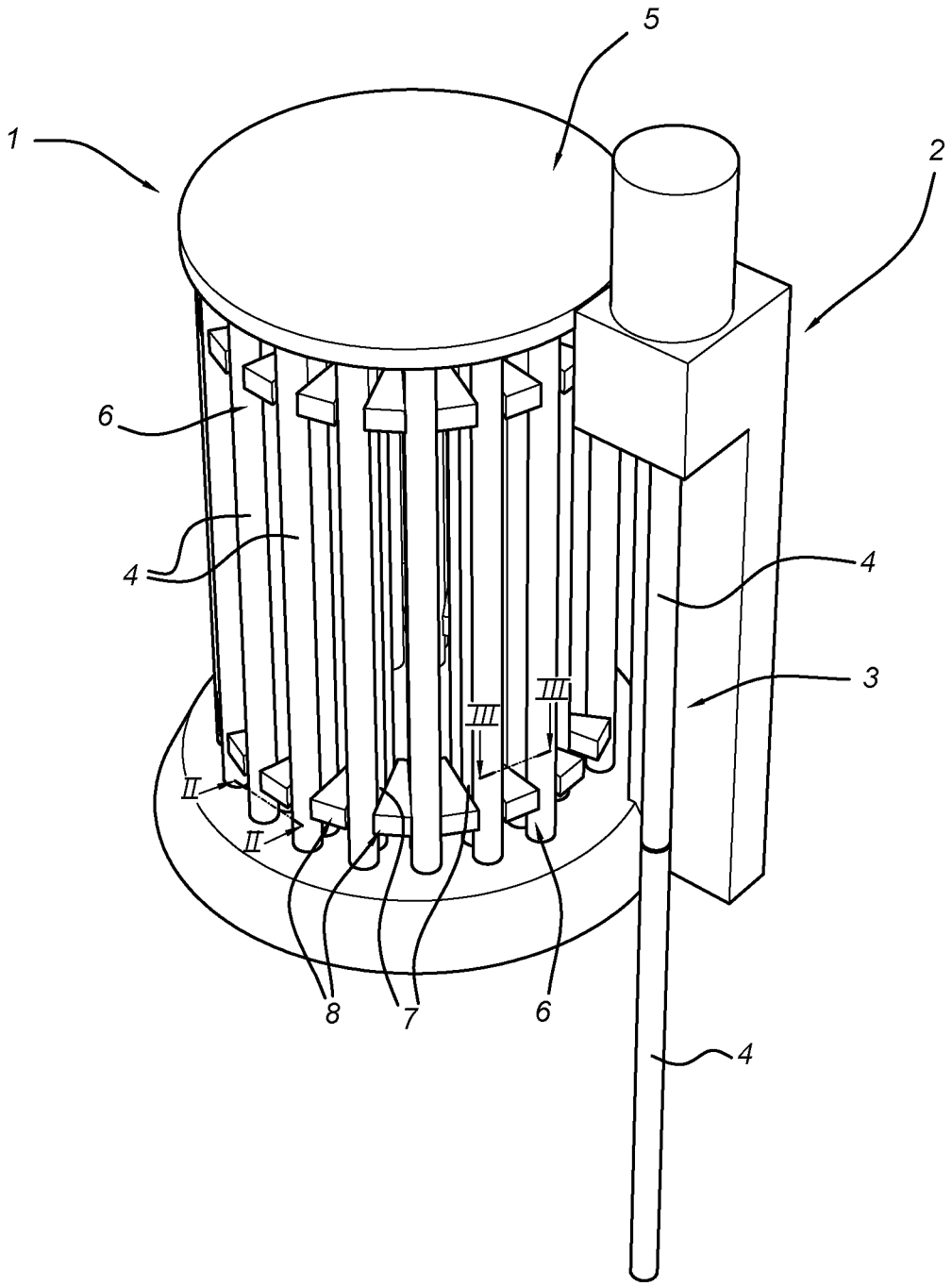
FIG. 1 shows a view in perspective of an installation with the tooling rack.

The drilling installation shown in FIG. 1 comprises the tooling rack 1 as well as a drilling device 2 which is known per se. By means of the drilling installation, the drill string 3, consisting of consecutive drill pipes 4, can be assembled and driven into the ground, respectively removed from the ground and disassembled. The drill pipes 4 are stored in the tooling rack, and can be removed there from, and respectively introduced therein, by means of a robot (not shown) which is known per se.

Figure 3:
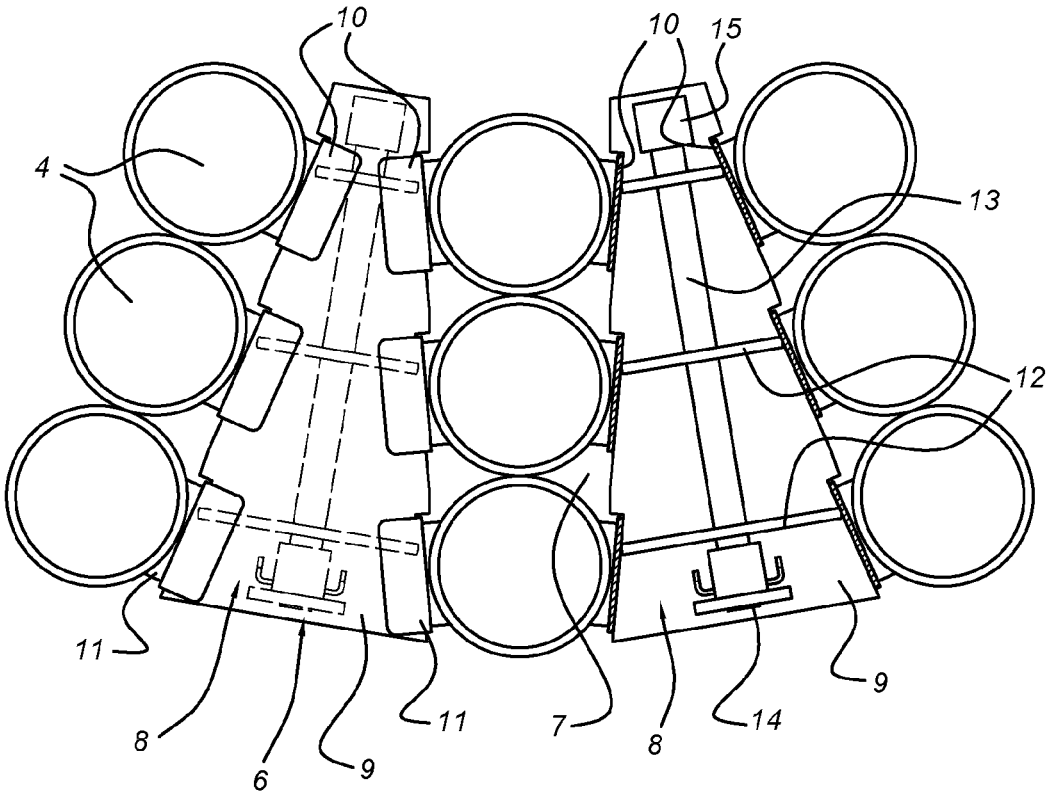
FIG. 3 shows a partial horizontal view according to III-III of FIG. 1.

The tooling rack 1 as shown is carried out as a carousel which consists of the two rack elements 6 which each have a multitude of slots 7 which are defined between radially extending fingers 8. Each rack element 6 consists of two parallel rack plates 9, as well as blade springs 10 which extend between the rack plates 9. Each blade spring carries a friction block 11, in such a way that a drill pipe may be frictionally held between two friction blocks 11 and blade springs 10 as shown in FIGS. 1-3. Thus, the robot may push the drill string between the friction blocks, in such a way that the blade springs 10 are deformed elastically and give way to receive the drill pipe 4. Thereby, a certain compression force is exerted on the drill pipe. Conversely, the robot may remove the drill pipe from between the friction blocks 11 by exceeding the friction force which is exerted thereby on the drill pipe 4 under the influence of the deformed blade springs 10.

As is shown in the drawings, several pairs of blade springs 10 with friction blocks 11 are arranged behind each other along a slot 7 so as to accommodate several drill pipes.

The handling of the drill pipes may usually be carried out satisfactorily in the above way. However, under certain circumstances the drill pipes are prone to be lost from the carousel, for instance as a result of sharp movements in the drilling installation and shocks. It appears that the blade springs provide a limited restraining force on the drill pipes, which results in a limited frictional engagement between the drill pipes and the friction blocks as well. However, it is not feasible to increase the friction force by increasing the elastic compression delivered by the blade springs, as otherwise the forces exerted on the drill pipes for placement in, or removal thereof from, the carousel would become too high.

With the aim of solving this problem, the locking means 12-16 are provided. These locking means consists of the double cams 12 and the shaft 13 onto which the cams 12 have been mounted. The shaft 13 is rotatably supported in the lug 14 and bearing 15 is driven by an external mechanism. As shown in FIG. 4*a*, the double cams each engage two blade springs 10 of adjacent slots 7, in such a way that that friction blocks 11 are firmly pressed onto the drill pipe 4 in question. Thus, the risk of losing the drill pipe 4 from between the friction blocks under the influence of shocks and the like is greatly mitigated.

However, when placing a drill pipe 4 into a slot 7 and between the friction blocks 11, or respectively removing the drill pipe, the cams 12 are rotated into the idle position as shown in FIG. 4*b*. The holding action of the cams exerted on the blade springs 10 is thus released, allowing the robot to place/remove the drill pipe. The double cam has opposite rounded surfaces 16, in such a way that they can come in contact with the respective surfaces of the blade springs 10 in a gradual fashion.

LIST OF REFERENCE NUMERALS

1. Tooling rack
2. Drilling device
3. Drill string
4. Drill pipe
5. Carousel
6. Rack element
7. Slot
8. Finger
9. Rack plate
10. Blade spring
11. Friction block
12. Double cam
13. Shaft
14. Lug
15. Bearing
16. Rounded surface cam

The invention claimed is:

1. A tooling rack for storing objects, comprising at least one rack element which is provided with at least one slot, each slot being bordered by resilient opposite holding elements with a first side and a second side, wherein an object is to be accommodated between the respective second sides of the resilient opposite holding elements, said resilient opposite holding elements being carried for exerting a holding force on the object, respectively for giving way to release the object from said holding force, and locking means, said locking means in a locking state directly contacts the first side of the the resilient opposite holding elements and prevents said resilient opposite holding elements from giving way and from releasing the holding force exerted on the object, and an idle state in which the locking means is not in contact with the first side of said resilient opposite holding elements and said resilient opposite holding elements are allowed to give way and release the object.

2. The tooling rack according to claim 1, comprising at least two spaced rack elements which are positioned with respect to each other such that a slot of one rack element is aligned to a respective slot of another rack element forming pairs or sets of slots, each pair or sets of slots being able to accommodate a single object.

3. The tooling rack according to claim 1, wherein each holding element comprises an elastic spring and the springs of opposite holding elements carrying a friction element.

4. The tooling rack according to claim 3, wherein the locking means comprise cams which are displaceable between the locking state in engagement with a respective spring, and the idle state not in contact with the respective spring.

5. The tooling rack according to claim 4, wherein each rack element comprises multiple slots each bordered by elastic springs, and between the spring of one slot and the neighboring spring of an adjacent slot a double cam is provided which in the locking state simultaneously engages both said neighboring springs.

6. The tooling rack according to claim 4, wherein a cam is rotatable between the locking state and the idle state.

7. The tooling rack according to claim 6, wherein several pairs of holding elements are arranged behind each other in the longitudinal direction of a slot, each pair being carried out for accommodating a respective object, wherein the locking means of respective holding elements lie behind each other in the longitudinal direction of the slot, wherein the respective cams of the respective holding elements which lie behind each other are accommodated on a common rotatable shaft.

8. The tooling rack according to claim 7, wherein the shaft is biased towards the locked position of the cams.

9. The tooling rack according to claim 8, wherein the shaft is biased towards the locked position of the cams by means of a torsion spring.

10. The tooling rack according to claim 4, wherein the spring is a blade spring a surface of which on the second side carries the friction element and the opposite surface of which, on the first side, is engageable by the cam.

11. The tooling rack according to claim 10, wherein the blade spring surfaces are directed in accordance with the longitudinal direction of the respective slot and the longitudinal direction of the object to be accommodated in said slot.

12. The tooling rack according to claim 11, wherein the blade spring has opposite ends which are suspended with respect to the respective rack element, in particular with respect to the rack plates thereof.

13. The tooling rack according to claim 3, wherein the friction element is a plastic element.

14. The tooling rack according to claim 1, wherein several pairs of holding elements are arranged behind each other in the longitudinal direction of a slot, each pair being carried out for accommodating a respective additional object.

15. The tooling rack according to claim 14, wherein each of the several pairs of holding elements have respective locking means; and the respective locking means of the respective holding elements lie behind each other in the longitudinal direction of the slot.

16. The tooling rack according to claim 15, wherein the locking means of the respective holding elements are simultaneously operable.

17. The tooling rack according to claim 1, wherein the slot of each rack element are oriented radially with respect to a central axis which is generally parallel to the objects to be accommodated in said slot.

18. The tooling rack according to claim 1, wherein the locking means in the locking state directly engage the resilient opposite holding elements to provide a radially oriented force on the resilient opposite holding elements.

19. A drilling installation, comprising a frame, a drilling apparatus accommodated on the frame for rotary driving a drill string composed of successive interconnected drill pipes, and a tooling rack according to claim 1 for storing a supply of drill pipes to be used for composing the drill string.

* * * * *